US005809374A

United States Patent [19]

Tsuda et al.

[11] Patent Number: 5,809,374

[45] **Date of Patent: *Sep. 15, 1998**

[54] PROCESS CARTRIDGE INCLUDING A SEAL MEMBER FORMED FROM A LIQUID-FOAM MATERIAL

[75] Inventors: Tadayuki Tsuda, Hachioji; Kazumi Sekine; Isao Ikemoto, both of Kawasaki; Kazushi Watanabe, Yokohama; Akira Higeta, Funabashi; Nobuharu Hoshi, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 594,494

[22] Filed: Jan. 31, 1996

[30] Foreign Application Priority Data

Feb. 2, 1995 [JP] Japan ..... 7-015797

[51] Int. Cl.[6] ..... G03G 15/00; G03G 21/18

[52] U.S. Cl. ..... 399/111; 399/102

[58] Field of Search ..... 399/102, 105, 399/107, 111

[56] References Cited

U.S. PATENT DOCUMENTS

| | | | |
|---|---|---|---|
| 5,208,634 | 5/1993 | Ikemoto et al. | 399/111 |
| 5,223,893 | 6/1993 | Ikemto et al. | 399/111 |
| 5,331,372 | 7/1994 | Tsuda et al. | 399/114 |
| 5,404,198 | 4/1995 | Noda et al. | 399/107 |
| 5,465,136 | 11/1995 | Watanabe | 399/111 |
| 5,470,635 | 11/1995 | Shirai et al. | 428/131 |
| 5,475,470 | 12/1995 | Sasago et al. | 399/111 |
| 5,485,249 | 1/1996 | Higeta et al. | 399/105 |
| 5,502,547 | 3/1996 | Shirai | 399/102 |
| 5,550,617 | 8/1996 | Odagawa et al. | 399/111 X |
| 5,561,504 | 10/1996 | Watanabe et al. | 399/111 |
| 5,565,961 | 10/1996 | Shoji et al. | 399/111 |
| 5,623,328 | 4/1997 | Tsuda et al. | 399/111 |

FOREIGN PATENT DOCUMENTS 5-134488 5/1993 Japan .

*Primary Examiner*—Sandra L. Brase
*Assistant Examiner*—Sophia S. Chen
*Attorney, Agent, or Firm*—Fitzpatrick, Cella, Harper & Scinto

[57] ABSTRACT

The present invention provides a process cartridge removably mountable to a main body of an electrophotographic image forming apparatus, the process cartridge including an electrophotographic photosensitive member, a process device that acts on the electrophotographic photosensitive member and has a blade member acting on toner and a support member for supporting the blade member, and a seal member provided for preventing the toner from leaking from a predetermined area. The seal member is formed from liquid-foam material to be solidified as an elastomer, and the seal member is contacted with an edge portion of the support member.

15 Claims, 12 Drawing Sheets

PROCESS CARTRIDGE INCLUDING A SEAL MEMBER FORMED FROM A LIQUID-FOAM MATERIAL

BACKGROUND OF THE INVENTION

1. Field of the Invention

The present invention relates to a process cartridge for forming an image by utilizing developer (referred to as "toner" hereinafter) and an electrophotographic image forming apparatus to which such a process cartridge is mounted to form the image.

The process cartridge incorporates an electrophotographic photosensitive member and at least one of cleaning means and developing means and can be removably be mounted to the electrophotographic image forming apparatus. The electrophotographic image forming apparatus may be, for example, a laser beam printer, a copying machine, a facsimile system, a word processor and the like.

2. Description of the Related Art

In electrophotographic image forming apparatuses such as printers, an electrophotographic photosensitive member which is uniformly charged by a charger is selectively exposed to form a latent image. Then, the latent image is visualized by a developing device as a toner image which is in turn transferred onto a recording medium, thereby executing recording of the image. In such apparatuses, conventionally, the maintenance of various parts are performed by expert persons.

To avoid this, for example, as shown in FIG. 18, there has been proposed a technique in which a process cartridge is constituted by a cartridge frame obtained by interconnecting upper and lower frames 51, 50 and an electrophotographic photosensitive member 52, a charger 53, a developing device 54 and a cleaning device 55 are contained within the cartridge frame to form a cartridge unit. By exchanging the used cartridge unit with a new one by an operator, the cartridge in which the toner is used up or consumed and/or the service life of the electrophotographic photosensitive member and the like is expired can easily be changed and the maintenance can be facilitated.

The cleaning device 55 has a waste toner containing portion 55*a* for collecting the waste toner removed from the electrophotographic photosensitive member 52, and the waste toner containing portion 55*a* is defined by engaging a plurality of elements such as the upper and lower frames 51, 50 and a cleaning blade 55*b* and the like with each other. Further, the developing device 54 has a developing toner containing portion 54*a* for supplying the toner to the electrophotographic photosensitive member 52, and the developing toner containing portion 54*a* is defined by engaging a plurality of elements such as the upper and lower frames 51, 50 and a developing blade 54*b* and the like with each other.

A seal member 56 made of foamed polyurethane or the like is provided in each engagement portion between the elements so that the seal member is firmly contacted with the elements. In this way, the toner can be prevented from leaking from the waste toner containing portion 55*a* of the cleaning device 55 and the developing toner containing portion 54*a* of the developing device 54.

By the way, the inventors have proposed a technique in which such a seal member is formed by using liquid-foam material which can be cured as elastomer (refer to U.S. Pat. No. 5,208,643). This technique is very effective in practical use.

The present invention relates to an improvement in this technique.

SUMMARY OF THE INVENTION

An object of the present invention is to provide a process cartridge and an electrophotographic image forming apparatus to which such a process cartridge can be removably mounted, wherein repelling forces of seal members can be suppressed.

Another object of the present invention is to provide a process cartridge and an electrophotographic image forming apparatus using such a process cartridge, wherein deformation of parts or elements caused by repelling forces of seal members can be prevented and a sealing ability between each seal member and the elements contacted therewith can be improved without having to increase the strength of each element and without having to make each element bulky.

A further object of the present invention is to provide a process cartridge and an electrophotographic image forming apparatus, wherein seal members are formed by using liquid-foam material which can be cured as an elastomer and the seal members are disposed in contact with edge portions of blade support members.

Another object of the present invention is to provide a process cartridge and an electrophotographic image forming apparatus, wherein, by urging edge portions of blade support members against seal members, even if great repelling forces are generated when the seal members are compressed, influence of the repelling forces can be reduced, thereby preventing deformation of parts.

DETAILED DESCRIPTION OF THE PREFERRED EMBODIMENTS

The present invention will now be explained in connection with embodiments thereof with reference to the accompanying drawings.

First Embodiment

Figure 1:
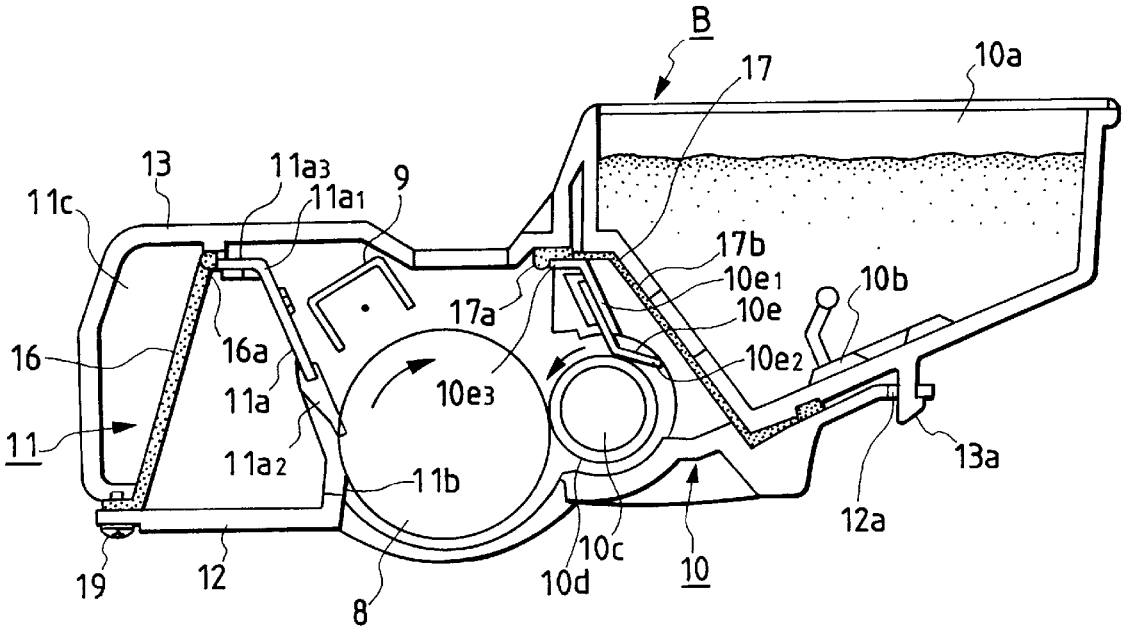
FIG. 1 is a schematic sectional view of a process cartridge according to a first embodiment of the present invention.

First of all, a process cartridge and an electrophotographic image forming apparatus to which such a process cartridge can removably be mounted according to a first embodiment of the present invention will be explained with reference to FIGS. 1 to 10. Incidentally, FIG. 1 is a schematic sectional view of a process cartridge according to the first embodiment of the present invention, FIG. 2 is a schematic sectional view of an electrophotographic image forming apparatus within which the process cartridge is mounted, FIG. 3 is a perspective view for explaining mounting of the process cartridge, and FIGS. 4 to 10 are views for explaining a seal arrangement.

Now, entire constructions of the process cartridge and the image forming apparatus having such a process cartridge will be firstly explained, and then, seal arrangements in a waste toner containing portion of a cleaning means and a developing toner containing portion of a developing means will be explained.

<Entire Construction>

Figure 2:
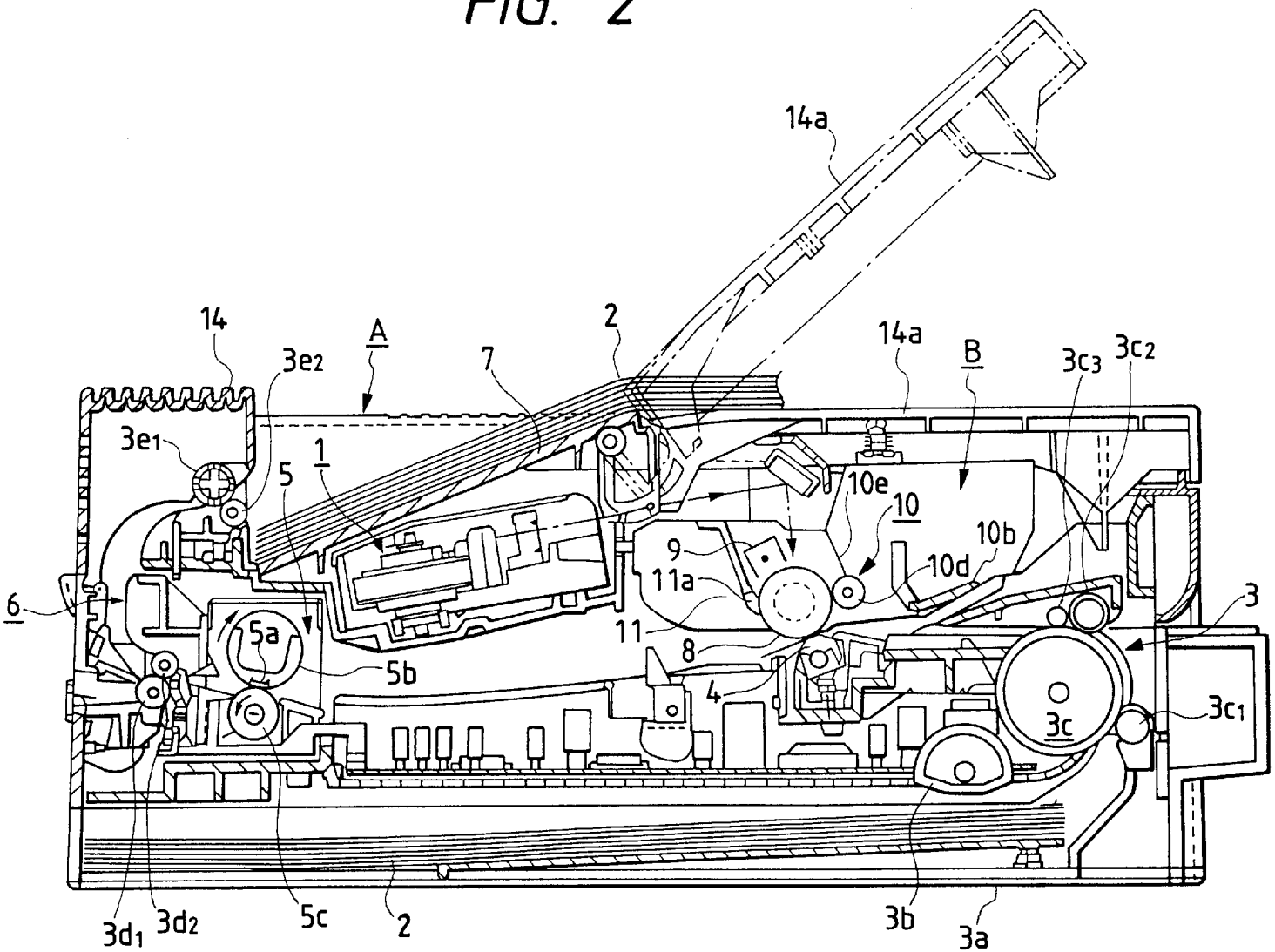
FIG. 2 is a schematic sectional view of an image forming apparatus within which the process cartridge is mounted.
Figure 3:
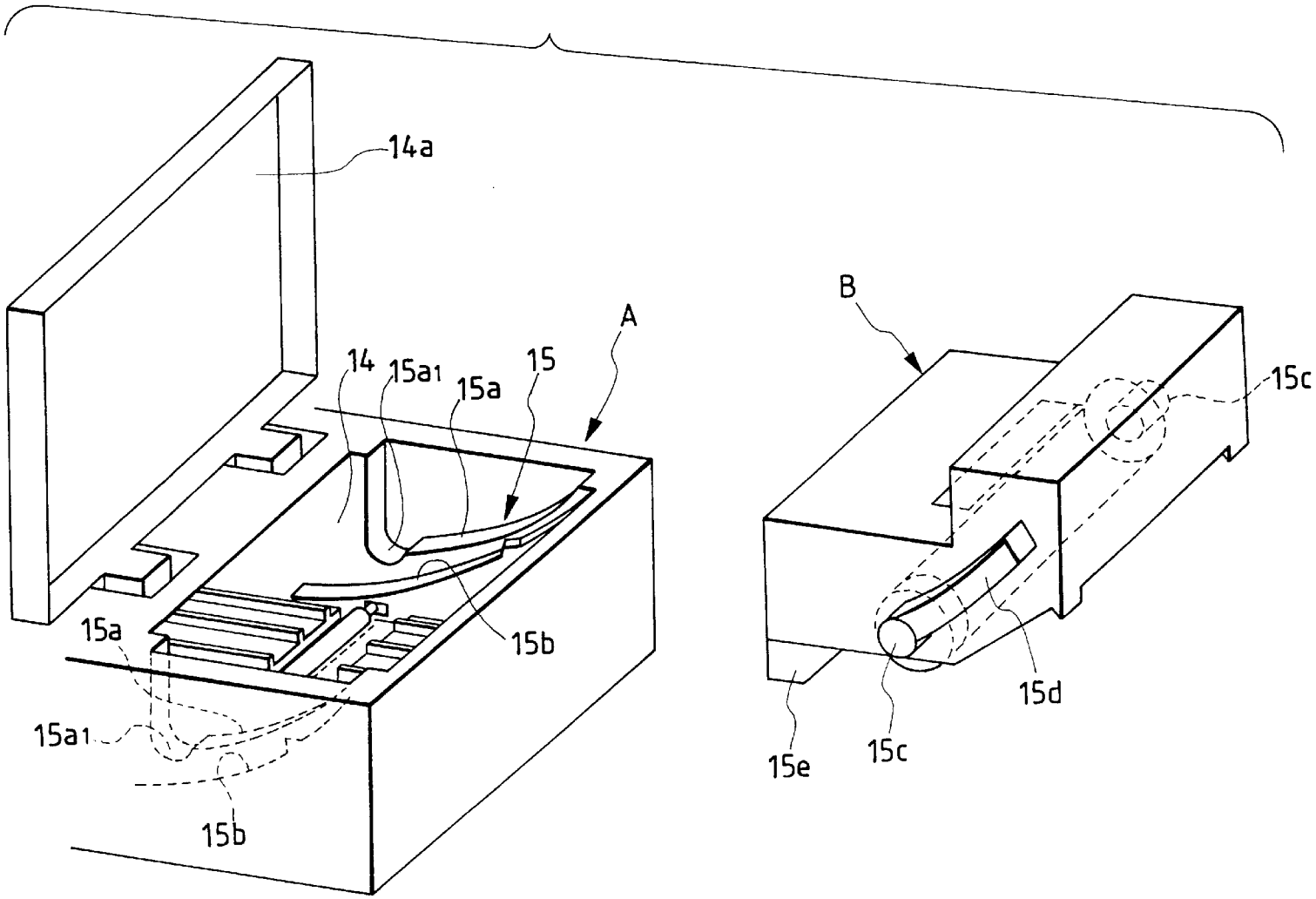
FIG. 3 is a perspective view for explaining mounting of the process cartridge.

As shown in FIG. 2, in the electrophotographic image forming apparatus (for example, laser beam printer) A, information light (corresponding to image information) from an optical system 1 is illuminated on a drum-shaped electrophotographic photosensitive member 8 to form a latent image, and the latent image is then developed to form a toner image. On the other hand, synchronously with the formation of the toner image, a recording medium 2 is supplied and conveyed from a cassette 3*a* by a convey means 3 comprising a pick-up roller 3*b*, a reverse rotation roller 3*c* and pinch rollers 3*c*1, 3*c*2, 3*c*3 urged against the reverse rotation roller and driven by rotation of the reverse rotation roller. When the recording medium 2 reaches the electrophotographic photosensitive member 8 incorporated into a process cartridge B, by applying voltage to a transfer roller (transfer means) 4, the toner image formed on the electrophotographic photosensitive member is transferred onto the recording medium 2. After the transferring of the toner image, the recording medium 2 is sent to fixing means 5 comprising a fixing rotary member 5*b* having a heater 5*a* therein and a drive roller 5*c* for urging the recording medium 2 against the fixing rotary member 5*b* to convey the recording medium. In the fixing device 5, the toner image is permanently fixed to the recording medium 2. Thereafter, the recording medium 2 is conveyed by a pair of discharge rollers 3*d*1, 3*d*2 and a pair of discharge rollers 3*e*1, 3*e*2 and is discharged into a discharge portion 7 through a reverse rotation convey path 6.

The process cartridge B further includes at least one process means, as well as the electrophotographic photosensitive member. The process means may, for example, be charge means for charging the electrophotographic photosensitive member, developing means for developing the latent image formed on the electrophotographic photosensitive member and/or cleaning means for cleaning or removing the residual toner remaining on the electrophotographic photosensitive member. In the illustrated embodiment, as shown in FIG. 1, in the process cartridge B, the electrophotographic photosensitive member, i.e., photosensitive drum 8 having a photosensitive layer thereon is rotated; meanwhile, a surface of the photosensitive drum 8 is uniformly charged by applying voltage to the charger (charge means) 9. Then, the photosensitive drum 8 is exposed by the information light from the optical system 1 through an exposure portion, thereby forming the latent image. The latent image is then developed by the developing means 10.

In the developing means 10, toner contained in a developing toner containing portion 10*a* is fed by a toner feed member 10*b* to a rotating developing roller 10*d* having a fixed magnet 10*c* therein. Then, a toner layer is formed on a surface of the developing roller 10*d* by a developing blade 10*e* while applying frictional charge to the toner layer. By transferring the toner from the toner layer to the latent image formed on the photosensitive drum 8, the latent image is visualized as a toner image. After the toner image is transferred onto the recording medium 2 by applying to the transfer roller 4 voltage having polarity opposite to that of the toner image, the residual toner remaining on the photosensitive drum 8 is removed from the photosensitive drum 8 by the cleaning means 11 comprising a cleaning blade 11*a* for scraping the residual toner away from the drum, a dip sheet 11*b* for receiving the removed toner (waste toner) and a waste toner containing portion 11*c* for collecting the waste toner.

Incidentally, the above-mentioned various elements such as the photosensitive drum are housed and supported within a housing obtained by interconnecting upper and lower frames 13, 12 to each other, thereby providing a cartridge which can removably be mounted to a cartridge mounting means provided within a body 14 of the apparatus.

Regarding the cartridge mounting means, as shown in FIG. 3, when an open/close member 14*a* is opened, there is provided a cartridge mounting space within the apparatus body 14, and a pair of cartridge mounting guide portions 15 are formed on inner side surfaces of the apparatus body 14. Each guide portion 15 includes first and second guide rails 15*a*, 15*b* for guiding the insertion of the process cartridge B. On the other hand, the process cartridge B is provided at its outer side surfaces with cylindrical projections 15*c* each protruding outwardly in alignment with a rotation axis of the photosensitive drum 8 and having a radius substantially the same as a radius of a recessed portion 15*a*1 of each first guide rail 15*a*, and guide ridges 15*d* contiguous to the respective cylindrical projections 15*c*. Further, an engagement portion 15*e* is formed on a lower portion of a front (in a cartridge inserting direction) surface of the process cartridge B.

When the process cartridge B is mounted to the apparatus body, the process cartridge B is inserted into the cartridge mounting space while guiding the cylindrical projections 15*c* and the guide ridges 15*d* by means of the first guide rails 15*a* and guiding the engagement portion 15*e* by means of the second guide rails 15*b*. Then, by closing the open/close member 14*a*, the mounting of the process cartridge B to the image forming apparatus A is completed.

<Seal Arrangements for Waste Toner Containing Portion and the like>

Now, seal arrangements for the waste toner containing portion and the like will be explained. As shown in FIG. 1, the waste toner containing portion 11*c* is bordered by the upper and lower frames 13, 12, cleaning blade 11*a*, dip sheet 11*b* and photosensitive drum 8. In this case, the cleaning blade 11*a* and the dip sheet 11*b* are urged against the photosensitive drum 8, and a plurality of elements including the upper frame 13, lower frame 12 and cleaning blade 11*a* are engaged with each other. And, seal members 16 are provided in engagement portions between these elements, thereby preventing the toner from leaking through the engagement portions.

On the other hand, as shown in FIG. 1, the developing toner containing portion 10*a* is bordered by the upper and lower frames 13, 12, developing roller 10*d* and developing blade 10*e*. In this case, the developing blade 10*e* is urged against the developing roller 10*d*, and a plurality of elements including the upper frame 13, lower frame 12 and developing blade 10*e* are engaged with each other. And, seal members 17 are provided in engagement portions between these elements, thereby preventing the toner from leaking through the engagement portions.

Figure 4:
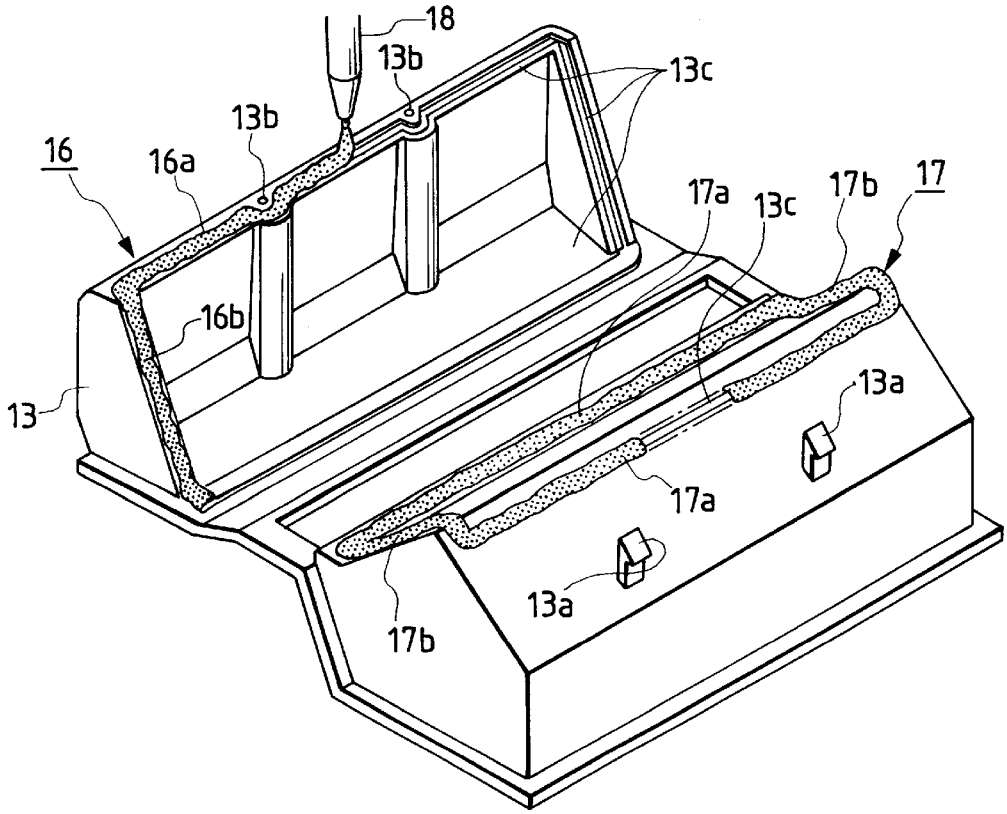
FIG. 4 is a perspective view for explaining formation of seal members by pouring liquid-foam material.

As shown in FIG. 4 (showing a condition that the upper frame 13 is opened to show the interior thereof), the seal members 16, 17 are formed from liquid-foam material (for example, foamed polyurethane) which can be cured or solidified as elastomer, which liquid-foam material is injected from a nozzle 18 into grooves 13*c* formed in the upper frame 13. The seal member 16 includes seal portions 16*a*, 16*b* attached to the upper frame 13 to encircle the waste toner containing portion 11*c*, and the seal member 17 includes seal portions 17*a*, 17*b* attached to the upper frame 13 to encircle the developing toner containing portion 10*a*.

Figure 5:
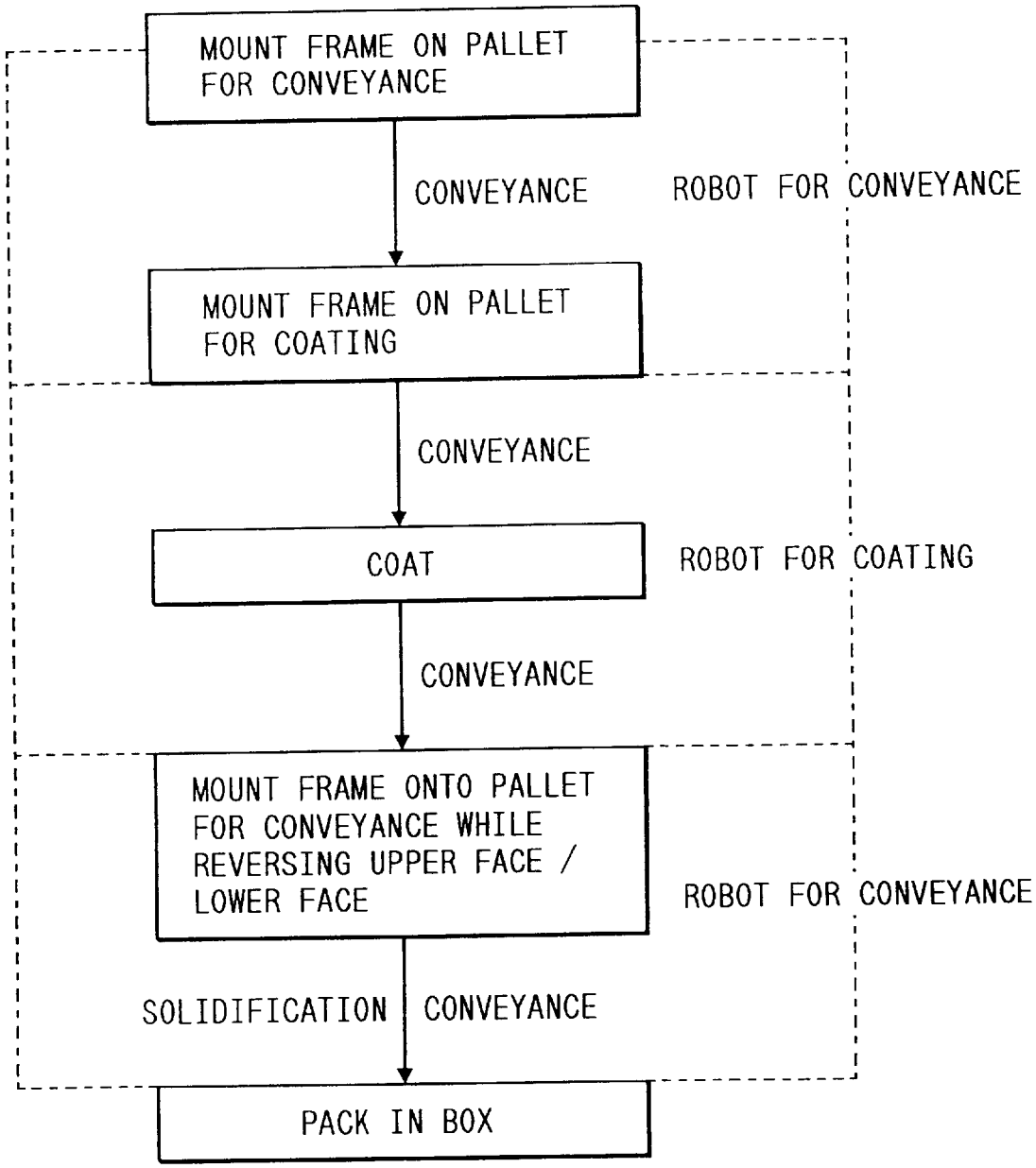
FIG. 5 is a flow chart for explaining the formation of the seal member by pouring the liquid-foam material.

Next, an example of a method for coating the seal member will be explained. First of all, as shown in FIG. 5, the frame is manually picked up from a box and is mounted on a pallet for conveyance (conveying pallet), and the frame together with the conveying pallet is conveyed to a position where it is associated with a robot for coating (coating robot) by means of a robot for conveyance (conveying robot). Thereafter, the frame is clamped by a frame clamping means of the conveying robot and then is mounted on a pallet for coating (coating pallet). Then, the coating pallet is conveyed to a coating position by means of the coating robot.

Then, a signal is transmitted from the coating robot to an injecting device, with the result that the coating of liquid-foam elastomer is effected. When the coating process is finished, the frame clamping means of the conveying robot picks up the frame again, and the frame is mounted on the conveying pallet again while reversing upper face/lower face. The frame mounted on the conveying pallet with the reversed upper face/lower face is conveyed for about 30 minutes; meanwhile, the liquid-foam elastomer is solidified to an extent that it is does not adhere to an operator's fingers. Further, during the conveyance of the frame for about 30 minutes, a temperature/humidity condition is maintained to permit adequate foaming. Thereafter, the frame is manually packed in a box.

In this way, since the formation of the seal members can be automated by using the coating system, the assembling of the process cartridge can be facilitated and the manufacturing cost can be reduced, with the result that the running cost of the image formation can be reduced.

Figure 6:
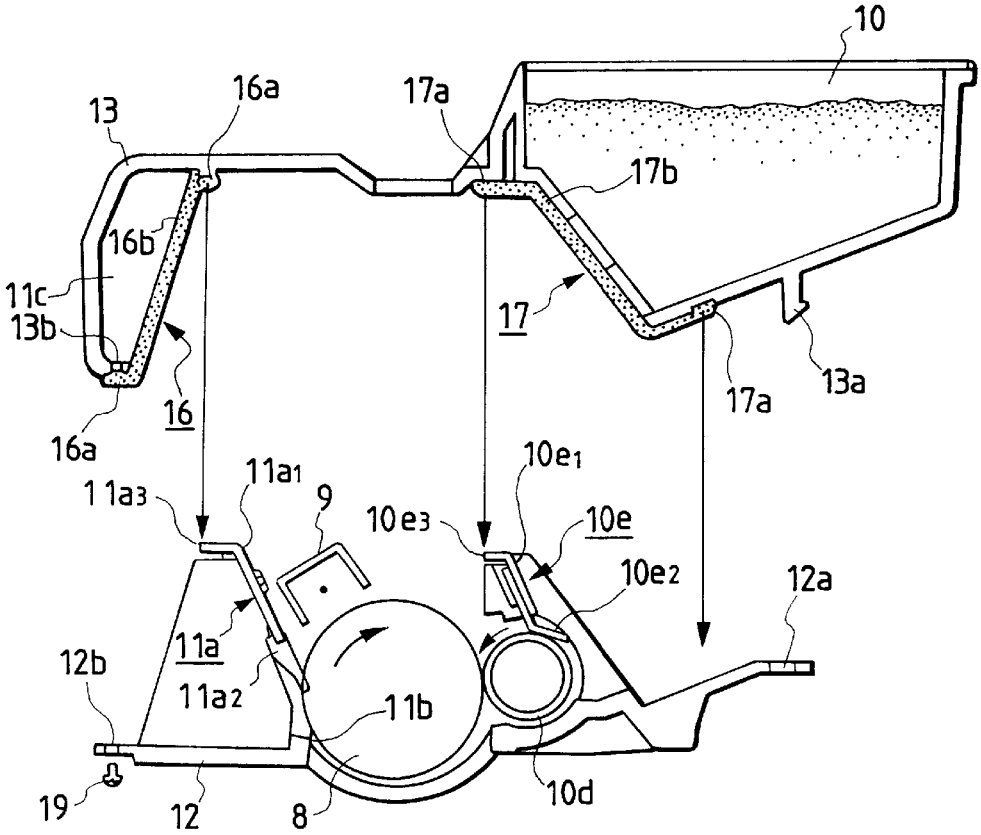
FIG. 6 is an exploded sectional view of the process cartridge showing a condition that upper and lower frames are separated from each other.

The cleaning blade 11*a* comprises a support member 11*a*1 formed from a plate member (such as a metal sheet) having a thickness of about 1–2 mm, and a blade member 11*a*2 made of rubber and attached to a tip end of the support member. As shown in FIG. 6, the support member 11*a*1 is secured to the lower frame 12 by screws and the like, and the blade member 11*a*2 is urged against the photosensitive drum 8 to remove the residual toner remaining on the photosensitive drum 8.

The developing blade 10*e* is similar to the cleaning blade 11*a*. Thus, the developing blade 10*e* comprises a support member 10*e*1 formed from a plate member (such as a metal sheet) having a thickness of about 1–2 mm, and a blade member 10*e*2 made of rubber and attached to a tip end of the support member. The support member 10*e*1 is secured to the lower frame 12 by screws and the like, and the blade member 10*e*2 is urged against the developing roller 10*d* to regulate the thickness of the toner layer formed on the rotating developing roller 10*d*.

After the seal members 16, 17 are coated in-this way and the blades 11*a*, 10*e* are attached to the frame, the frames 12, 13 are connected to each other by fitting locking pawls 13*a* formed on the upper frame 13 into locking holes 12*a* formed in the lower frame 12 and by threading screws 19 into threaded holes 12*b*, 13*b*.

Figure 7:
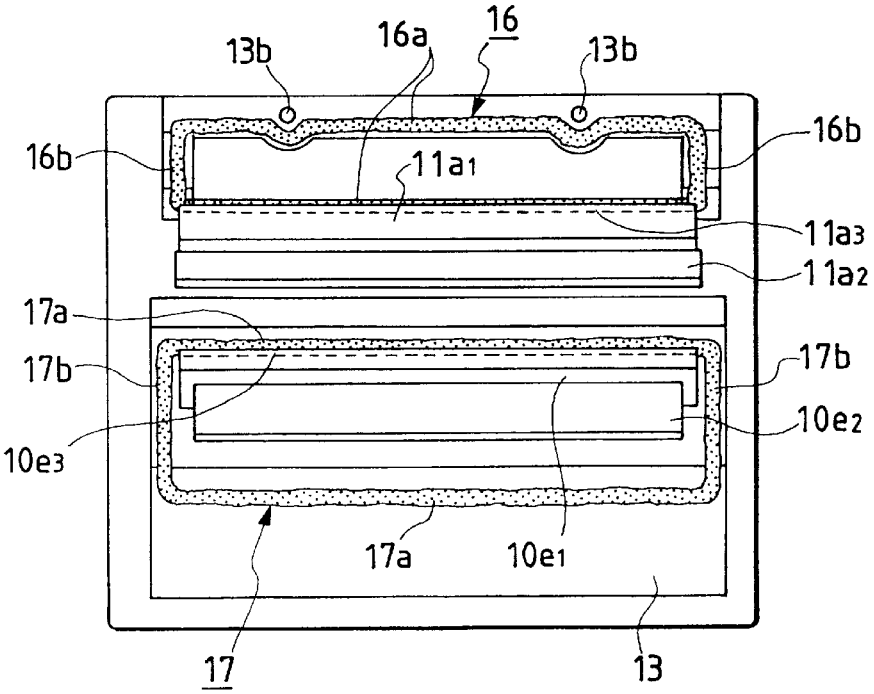
FIG. 7 is an explanatory view for showing a positional relation between the seal members and blade support members.

In this case, as shown in FIG. 7 (which is a plan view showing the interior of the upper frame 13 and further showing a positional relation between the seal members 16, 17, cleaning blade 11*a* and developing blade 10*e*), the cleaning blade 11*a* is attached so that a tip edge portion 11*a*3 of the support member 11*a*1 of the cleaning blade 11*a* is urged against the seal member 16. Similarly, the developing blade 10*e* is attached so that a tip edge portion 10*e*3 of the support member 10*e*1 of the developing blade 10*e* is urged against the seal member 17. That is to say, in a widthwise direction of the support members, longitudinal edges of the blade support members 10*e*1, 11*a*1 opposite to edges supporting the blades 10*e*2, 11*a*2 are urged against the seal members 17, 16.

As mentioned above, the seal members 16, 17 are formed from the liquid-foam elastomer which can be solidified as elastomer. Thus, repelling forces of the seal members when compressed become greater than that of molt plane which is conventionally used as a seal member, since skin layers are remaining on the seal members. However, as mentioned above, by urging the edge portions of the blade support members against the seal members, when the seal members 16, 17 are compressed, the repelling forces can be reduced. Now, the reduction of the repelling force will be explained with reference to a graph shown in FIG. 8.

Figure 8:
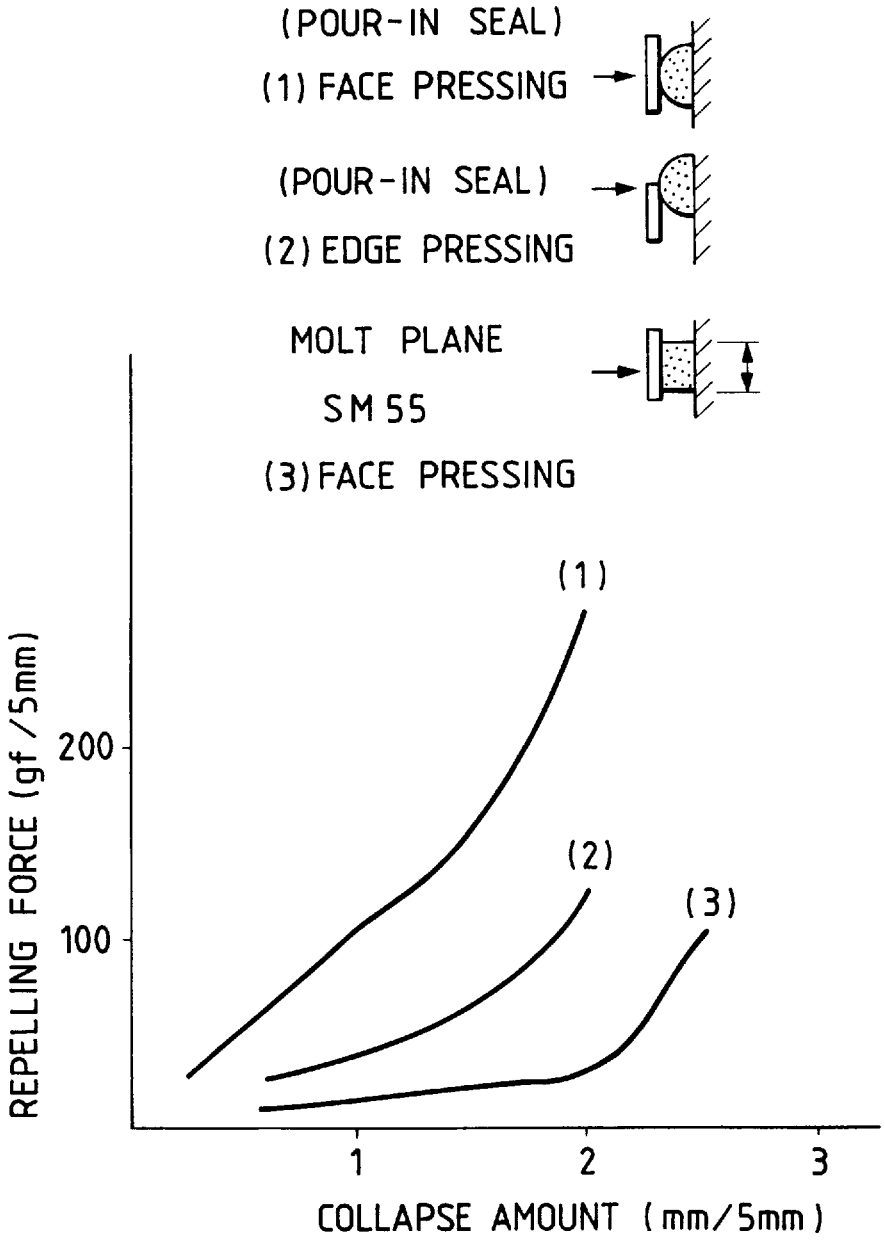
FIG. 8 is a graph showing a relation between a repelling force and a collapse amount when the seal member is pressed.

In the graph of FIG. 8, the abscissa indicates a collapse amount of the seal member (1–3 mm/5 mm) and the ordinate indicates the repelling force (gf/5 mm) in association with such a collapse amount. Further, a curve (1) indicates a result obtained when the seal member formed by pouring the liquid-foam material as is in the illustrated embodiment is face-pressed by the blade support member, a curve (2) indicates a result obtained when the seal member formed by pouring the liquid-foam material as in the illustrated embodiment is edge-pressed by the edge portion of the blade support member, and a curve (3) indicates a result obtained when a seal member comprised of molt plane (SM55; thickness of 3 mm) as in the conventional case is face-pressed by a blade support member.

As can be understood from the graph of FIG. 8, in comparison with the repelling force (curve (3)) generated when the conventional seal member (molt plane) from which the skin layer was removed is face-pressed, the repelling force (curve (1)) generated when the seal member with the skin layer as in the illustrated embodiment is face-pressed is greater by five times or more, regarding the collapse amount of 1 mm. However, the repelling force (curve (2)) generated when the seal member is collapsed or pressed by the edge of the blade support member (such as a metal sheet) is reduced to half or less in comparison with the repelling force of the curve (1) (face-pressing). This is the reason why, even if the collapse amount of the seal member when face-pressed is the same as the collapse amount of the seal member when edge-pressed, the volume change ratio of the seal member when face-pressed is smaller than that when edge-pressed, with the result that the repelling force of the seal member when edge-pressed becomes smaller than that when face-pressed.

As a result of tests, regarding the seal member formed by pouring the liquid-foam material as in the illustrated embodiment, since the sealing ability is substantially the same so long as the collapse amount is the same, it was found that the repelling force can be reduced without worsening the sealing ability, by urging the edge portions of the blade support members against the seal member as in the illustrated embodiment.

Accordingly, in the illustrated embodiment, since the repelling forces of the seal members 16, 17 are reduced, it is possible to prevent the deformation of the upper frame due to the repelling force, to closely contact the seal members 16, 17 with the upper frame 13 and the blade support members 11*a*1, 10*e*1 and to prevent the leakage of the toner. Further, the deformation of the blade support members 11*a*1, 10*e*1 can be prevented, and the poor cleaning and the uneven thickness of the toner layer can also be prevented.

With the arrangement as is in the illustrated embodiment, when the contact areas between the blade support members 11*a*1, 10*e*1 and the seal members are long, it is particularly effective to prevent the deformation of a central portion (in a longitudinal direction) of the upper frame 13.

Incidentally, in the illustrated embodiment, while an example that edge portions of the blade support members 11*a*1, 10*e*1 for both of the cleaning blade 11*a* and the developing blade 10*e* are urged against the seal members was explained, regarding either the cleaning blade 11*a* or the developing blade 10*e*, the tip edge portion of the support member may be urged against the seal member.

Figure 9A:
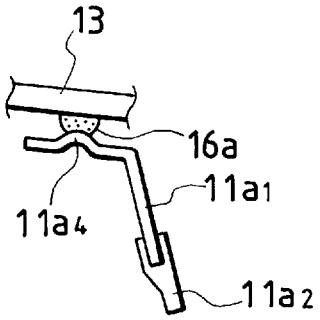
FIGS. 9A and 9B are explanatory views showing a blade support member having a protruded portion.
Figure 9B:
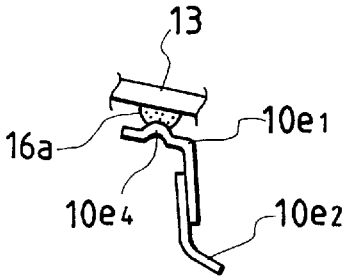

Further, in the illustrated embodiment, while an example that the edge portions of the blade support members 11*a*1, 10*e*1 are urged against the seal members 16, 17 was explained, as shown in FIGS. 9A and 9B, protruded portions 11*a*4, 10*e*4 extending in a longitudinal direction may be formed on upper surfaces of the blade support members 11*a*1, 10*e*1 and such protruded portions 11*a*4, 10*e*4 may be urged against the seal members 16, 17. When the blade support members 11*a*1, 10*e*1 are press-worked from sheet metal, the protruded portions 11*a*4, 10*e*4 can easily be formed by the drawing operation. Alternatively, when the blade support members 11*a*1, 10*e*1 are formed by extrusion, the protruded portions 11*a*4, 10*e*4 can easily be obtained by providing protruded areas in extrusion dies. When the blade support members 11*a*1, 10*e*1 are formed from resin, the protruded portions 11*a*4, 10*e*4 can easily be obtained by injection-molding them to provide the protruded portions.

In this way, when the protruded portions 11*a*4, 10*e*4 formed on the blade support members 11*a*1, 10*e*1 are urged against the seal members 16, 17, the same advantage as that when the edge portions of the blade support members are urged against the seal members can be achieved.

Figure 10:
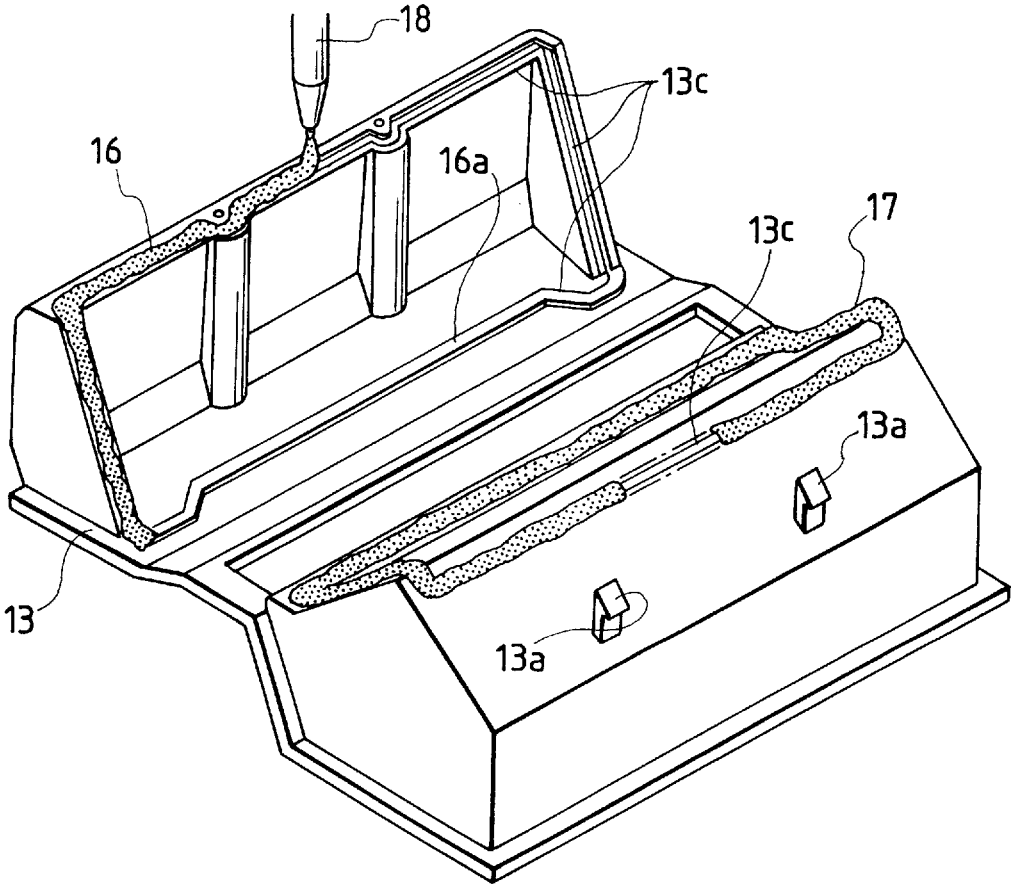
FIG. 10 is a perspective view showing a seal arrangement according to an embodiment of the present invention in which a central area (in a longitudinal direction) of an edge portion of a blade support member is urged against a seal member.
Figure 11:
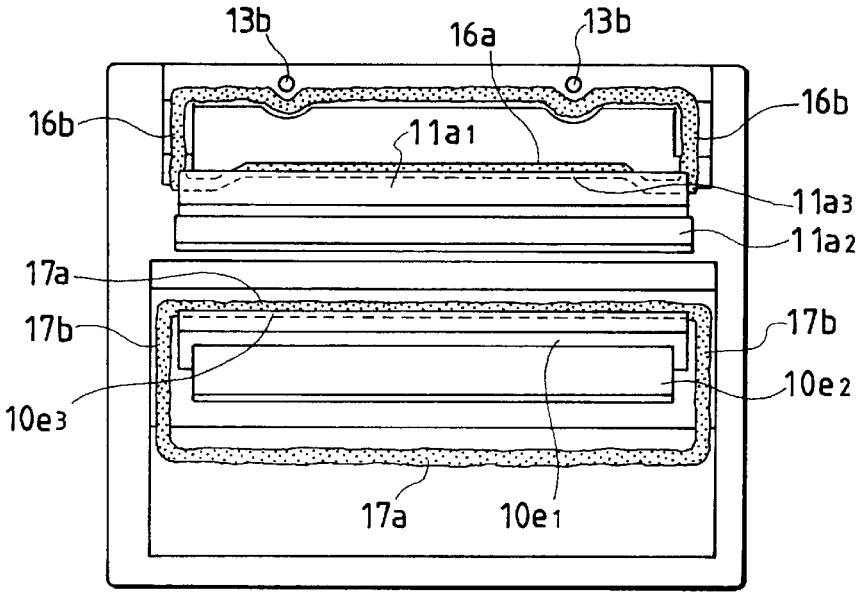
FIG. 11 is an explanatory view for showing a positional relation between the seal members and the blade support members in the embodiment of FIG. 10.

Further, in the illustrated embodiment, while an example that the entire longitudinal edge portions of the blade support members 11*a*1, 10*e*1 are urged against the seal members 16, 17 or the longitudinal protruded portions formed on the blade support members along their entire lengths are urged against the seal members 16, 17 was explained, only a central edge portion or a central protruded portion (in a longitudinal direction) of each blade support member may be urged against the corresponding seal member. For example, as shown in FIGS. 10 and 11, a seal portion 16*a* of the seal member 16 which is to be contacted with the cleaning blade support member 11*a*1 is formed to be trapezoidal, and a central edge portion 11*a*3 of the support member 11*a*1 is urged against the seal member 16 (edge-pressing) and both end portions of the support member 11*a*1 is urged against the seal member (face-pressing).

If the upper frame 13 is deformed by the repelling force of the seal member, the influence of the repelling force is great at the longitudinal central portion of the frame. Thus, only at the longitudinal central portion, which is apt to be subjected to the influence of the repelling force, is the edge portion 11*a*3 of the support member 11*a*1 urged against the seal member 16 (edge-pressing).

Also with this arrangement, the repelling force of the seal member can be reduced and the deformation of the upper frame 13 can be prevented. Incidentally, while FIGS. 10 and 11 showed the cleaning blade 11*a*, it should be noted that a similar arrangement can be applied to the developing blade 10*e*.

Second Embodiment

In the above-mentioned first embodiment, while an example that the repelling forces of the compressed seal members are reduced by edge-pressing the edge portions of the blade support members against the seal members to prevent the deformation of the upper frame 13 was explained, a second embodiment in which the deformation of the upper frame 13 due to the repelling forces of the seal members can be prevented will be explained with reference to FIG. 12. Incidentally, in the second embodiment, since the fundamental construction of a process cartridge B is substantially the same as that of the first embodiment, elements having the same function as those in the first embodiment are designated by the same reference numerals and explanation thereof will be omitted. Further, since an image forming apparatus to which the process cartridge B according to the second embodiment is mounted is substantially the same as the image forming apparatus explained in connection with the first embodiment, detailed explanation of the image forming apparatus will be omitted.

Figure 12:
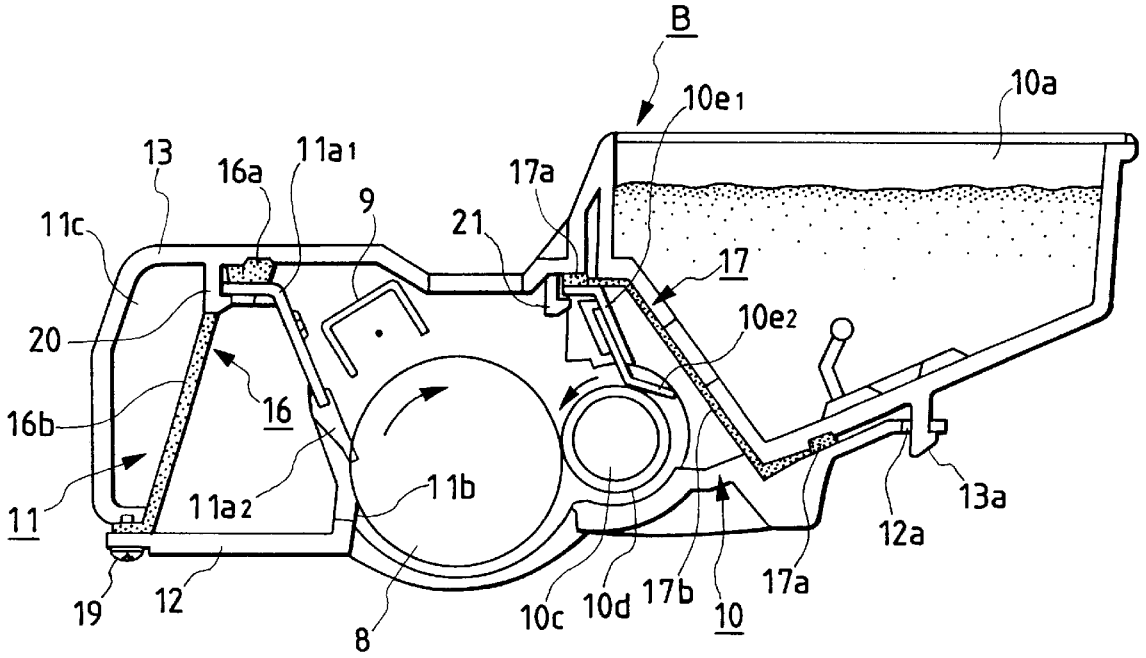
FIG. 12 is a sectional view of a process cartridge according to an embodiment of the present invention in which locking means is provided in the vicinity of a seal members.

In the second embodiment, as shown in FIG. 12, locking pawls (connecting means) 20 are formed on an inner upper surface of the upper frame 13 constituting a part of the waste toner containing portion 11*c* in the vicinity of the engagement portion between the seal member 16 and the blade support member 11*a*1 so that, when the upper and lower frames 13, 12 are interconnected, the locking pawls 20 are locked to the blade support member 11*a*1.

With this arrangement, even if the upper frame 13 tries to be deformed upwardly due to the repelling force of the seal member 16, the deformation of the upper frame is prevented by the locking pawls 20. Accordingly, the seal member 16 is closely contacted with the upper frame 13 and the blade support member 11*a*1, thereby preventing leakage of toner.

Further, regarding the developing blade 10*e*, the same arrangement as mentioned above can be adopted. That is to say, locking pawls (connecting means) 21 are formed on an inner upper surface of the upper frame 13 constituting a part of the developing toner containing portion 10*a* in the vicinity of the engagement portion between the seal member 17 and the blade support member 10*e*1 so that, when the upper and the lower frames 13, 12 are interconnected, the locking pawls 21 are locked to the blade support member 10*e*1.

With this arrangement, as in the waste toner containing portion, the deformation of the upper frame 13 due to the repelling force of the seal member 17 can be prevented. Thus, the seal member 17 is closely contacted with the upper frame 13 and the blade support member 10*e*1, thereby preventing leakage of toner.

Incidentally, in the embodiment shown in FIG. 12, while an example that the locking pawls 20, 21 are locked to the blade support members 11*a*1, 10*e*1 having relatively great strength was explained, the present invention is not limited to such an example, but, any members for connecting the parts may be provided between the parts in the vicinity of the seal members 16, 17 and the locking pawls 20, 21 may be locked to such members.

Third Embodiment

Next, a third embodiment of the present invention in which the repelling forces of the seal members can be reduced will be explained with reference to FIGS. 13 to 17. Incidentally, also in this case, since the fundamental construction of a process cartridge B is substantially the same as that of the first embodiment, elements having the same function as those in the first embodiment are designated by the same reference numerals and explanation thereof will be omitted. Further, since an image forming apparatus to which the process cartridge B according to the third embodiment is mounted is substantially the same as the image forming apparatus explained in connection with the first embodiment, detailed explanation of the image forming apparatus will be omitted.

Figure 13:
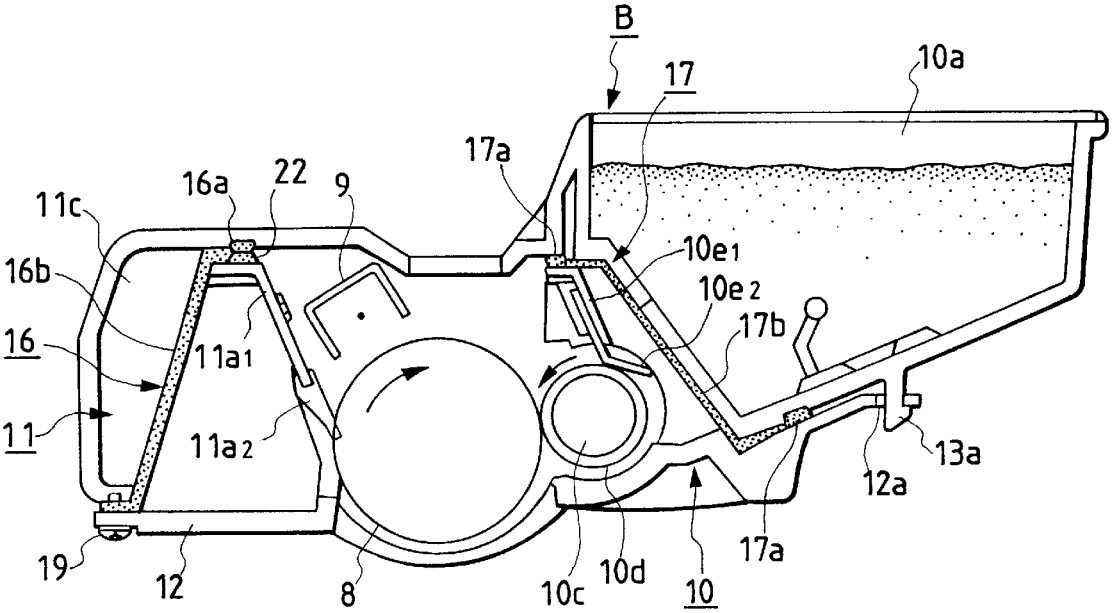
FIG. 13 is a sectional view of a process cartridge according to an embodiment of the present invention in which seal members are urged against each other to provide a sealing function.
Figure 14:
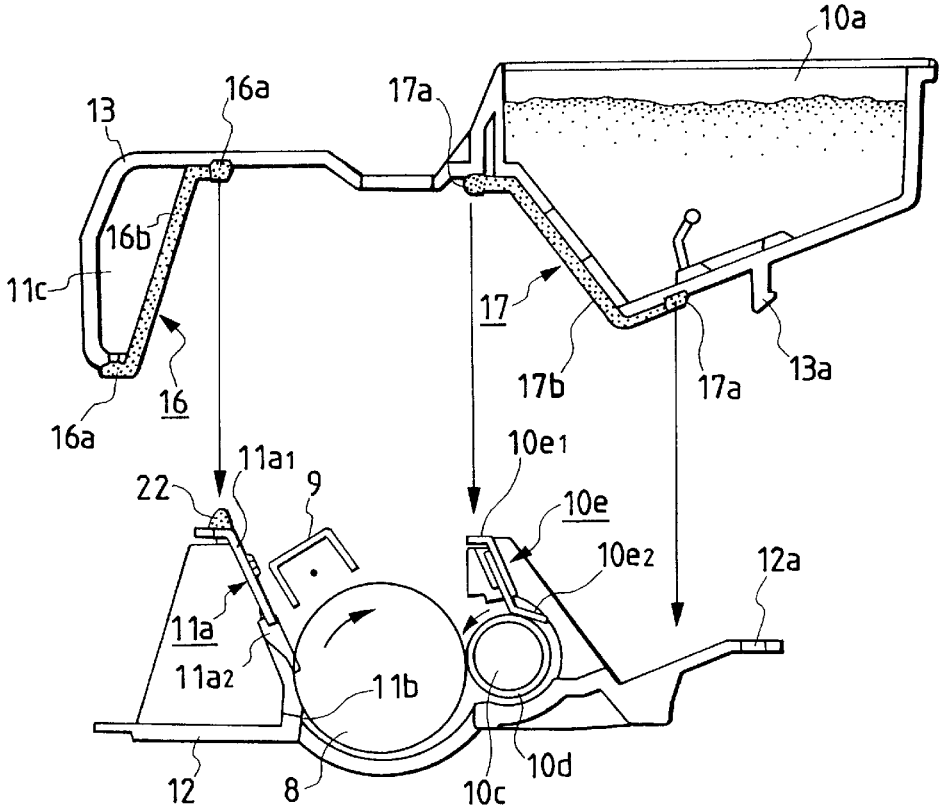
FIG. 14 is an exploded sectional view of the process cartridge of FIG. 13 showing a condition that upper and lower frames are separated from each other.

In this third embodiment, as shown in FIGS. 13 and 14, there is a seal portion 16*a* of the seal member 16 (formed from the liquid-foam material) on an inner surface of the upper frame 13 constituting a part of the waste toner containing portion 11*c* in a confronting relation to the cleaning blade support member 11*a*1. In this case, the seal portion 16*a* is shaped (from the liquid-foam material) to be convex toward a direction from which the upper frame 13 is engaged by the blade support member 11*a*1 (i.e., the downward direction in FIG. 13).

On the other hand, a seal member 22 is formed (from liquid-foam material in the same manner as the seal member 16) on an upper surface of the cleaning blade support member 11*a*1 in a confronting relation to the seal portion 16*a*. In this case, the seal member 22 is shaped (from the liquid-foam material) to be convex toward a direction from which the blade support member 11*a*1 is engaged by the upper frame 13 (i.e., the upward direction in FIG. 13).

When the waste toner containing portion 11*c* is formed by interconnecting the upper and lower frames 13, 12, the seal portion 16*a* of the seal member 16 and the seal member 22 are engaged by each other to form a seal. In this way, by forming the seal by urging the seal members against each other, the repelling forces of the seal members can be further reduced, in comparison with the case where the seal is formed by face-pressing the blade support member against the seal member formed from the liquid-foam material (which can be solidified as elastomer). The reduction of the repelling force will now be explained with reference to a graph shown in FIG. 15.

Figure 15:
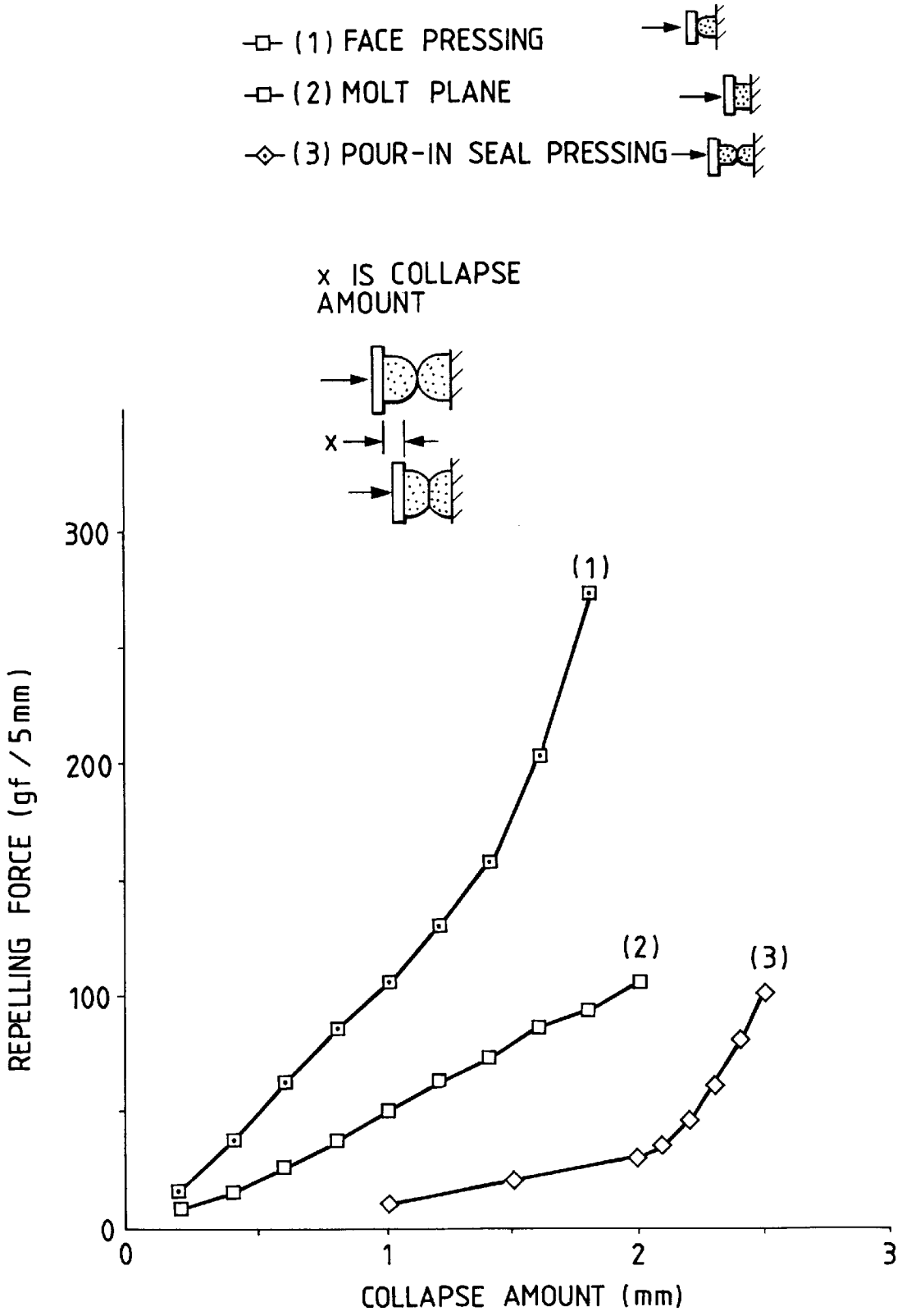
FIG. 15 is a graph showing a relation between a repelling force and a collapse amount when the seal member is prepared, in the process cartridge of FIG. 13.

In the graph of FIG. 15, the abscissa indicates a collapse amount of the seal member (1–3 mm/5 mm) and the ordinate indicates the repelling force (gf/5 mm) in association with such a collapse amount. Further, a curve (1) indicates a result obtained when the seal member formed by pouring the liquid-foam material as is in the illustrated embodiment is face-pressed by the blade support member, a curve (2) indicates a result obtained when the seal members formed by pouring the liquid-foam material as is in the illustrated embodiment are urged against each other, and a curve (3) indicates a result obtained when a seal member comprised of molt plane (SM55; thickness of 3 mm) as in the conventional case is face-pressed by a blade support member (Incidentally, the curves (1) and (3) are the same as the curves (1) and (3) shown in FIG. 8 regarding the first embodiment).

As explained in connection with the first embodiment, in comparison with the repelling force (curve (3)) generated when the conventional seal member (molt plane) is face-pressed, the repelling force (curve (1)) generated when the seal member is face-pressed is greater by five times or more, regarding the collapse amount of 1 mm. However, the repelling force (curve (2)) generated when the seal members are urged against each other is reduced to half or less in comparison with the repelling force of the curve (1) (face-pressing). This is the reason why, even when the collapse amounts are the same, the volume change ratio of the seal members when urged against each other is smaller than that when face-pressed, with the result that the repelling forces of the seal members when urged against each other becomes smaller than that when face-pressed.

Accordingly, in the third embodiment, since the repelling force of the seal member 16 is reduced, it is possible to prevent the deformation of the upper frame 13 due to the repelling force, to closely contact the seal member 16 with the upper frame 13 and the blade support members 11*a*1 and to prevent the leakage of the toner. Further, the deformation of the blade support members 11*a*1 can be prevented, and the poor cleaning and the uneven thickness of the toner layer can also be prevented.

Figure 16:
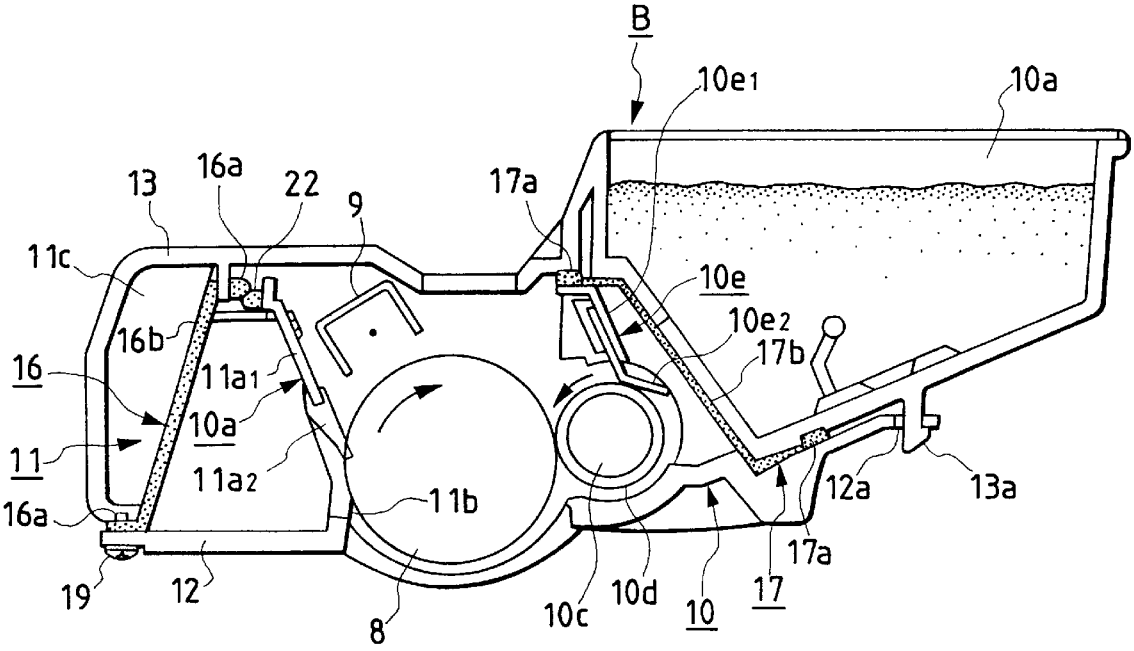
FIG. 16 is a sectional view of a process cartridge according to an embodiment of the present invention in which seal members are protruded in a direction perpendicular to an engagement direction.

Incidentally, in the embodiment shown in FIG. 13, while an example that the seal members 16, 22 are convex toward the engagement direction between the upper frame 13 and the blade support member 11*a*1 was explained, as shown in FIG. 16, the seal portion 16*a* of the seal member 16 and the seal member 22 engaged by the seal portion may be convex toward a direction (left/right direction in FIG. 16) perpendicular to the engagement direction (up/down direction in FIG. 16) between the upper frame 13 and the blade support member 11*a*1. With this arrangement, when the upper frame 13 and the blade support member 11*a*1 are engaged by each other in the up/down direction, the repelling force generated by the urging between the seal members 16, 22 can be further reduced, thereby preventing the deformation of the upper frame 13 due to the repelling force and further improving the prevention of leakage of toner.

Figure 17:
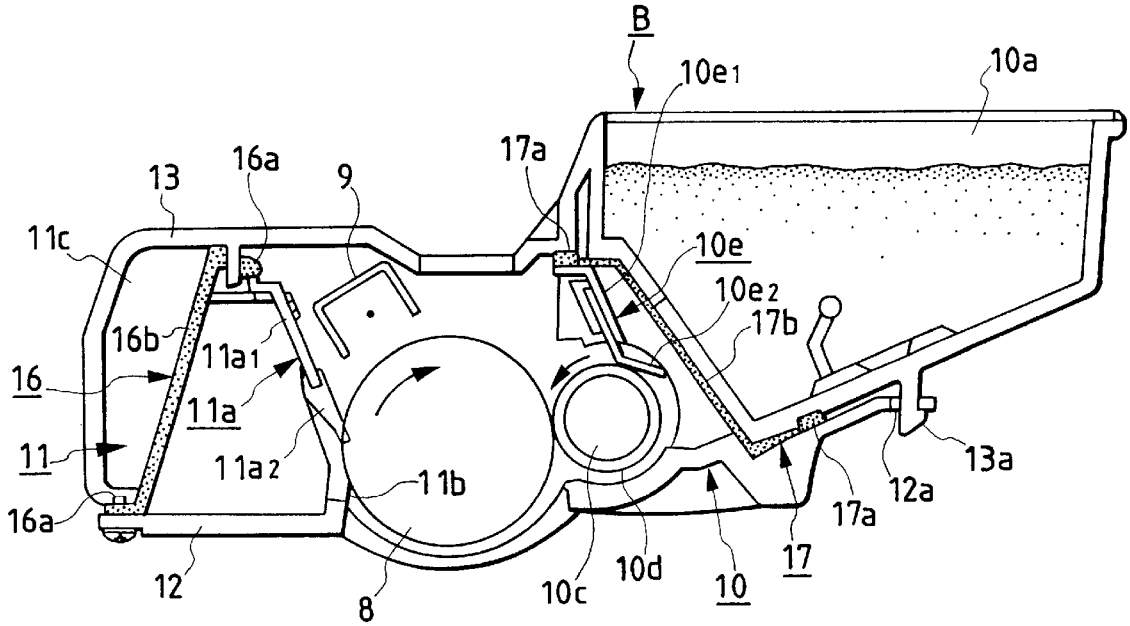
FIG. 17 is a sectional view of a process cartridge according to an embodiment of the present invention in which seal members are urged against associated members in a laid condition.
Figure 18:
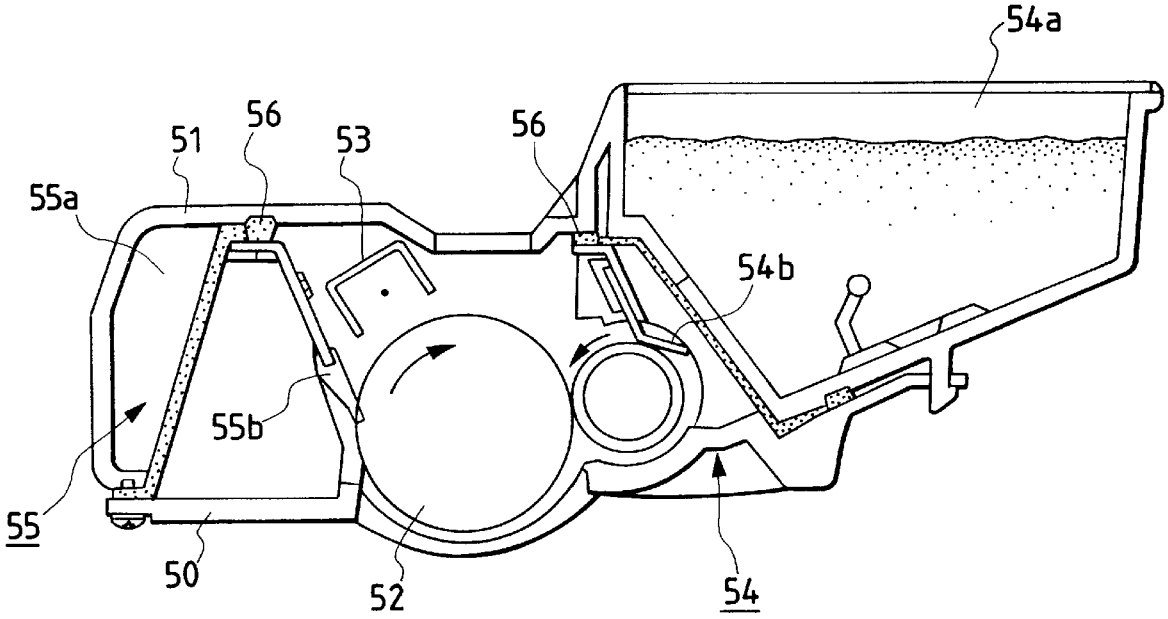
FIG. 18 PRIOR ART
FIG. 18 is a sectional view of a conventional process cartridge.

Further, in the embodiment shown in FIG. 13, while an example that the seal is formed by urging the seal members against each other was explained, as shown in FIG. 17, the seal portion 16*a* of the seal member 16 may be formed on one of the upper frame 13 and the blade support member 11*a*1 which are to be engaged by each other (in the illustrated embodiment, the seal portion is formed on the upper frame 13), and the seal portion 16*a* may be convex toward a direction perpendicular to the engagement direction (up/down direction in FIG. 17) so that the seal portion is laterally urged against the blade support member 11*a*1 to cause lateral deformation of the seal portion.

Also in this case, the repelling force of the seal portion 16*a* in the engagement direction can be reduced to prevent the camber (deformation) of the upper frame 13, thereby improving the sealing feature in the engagement portion to prevent the leakage of toner.

Incidentally, in FIG. 17, while an example that the seal portion 16*a* is urged against the support member 11*a*1 was shown, alternatively, the seal portion may be provided on the support member 11*a*1 so that the seal portion is urged against the upper frame. Also in this case, the same advantages can be obtained. Further, in the embodiment shown in FIG. 17, while the waste toner containing portion 11*c* was explained, as is in the above-mentioned embodiment, the same arrangement can be adopted to the engagement portion between the upper frame 13 constituting a part of the developing toner containing portion 10*a* and the developing blade support member 10*e*1. Also in this case, the same advantages can be obtained.

Further, the seal arrangement as shown in the third embodiment can be applied to any engagement portions between plural elements constituting a part of the toner containing portion, as well as the engagement portions between the frame and the blade support member. Also in this case, the same advantage can be obtained.

Other Embodiments

Next, other embodiments regarding various elements constituting the process cartridge will be explained.

The process cartridge B according to the above-mentioned embodiments is not limited to mono-color image formation, but, a plurality of developing means each including different color toner may be provided in the process cartridge to form a plural color image (for example, two-color image, three-color image or full-color image).

Further, a developing method used with the developing means may be a conventional two-component magnet brush developing method, a cascade developing method, a touch-down developing method, a cloud developing method or the like.

The photosensitive member is not limited to the photosensitive drum, but may be, for example, as follows. The photosensitive body is constituted by photo-conductor which may be, for example, amorphous silicone, amorphous selenium, zinc oxide, titanium oxide, organic photo-conductor (OPC) or the like. Further, the photosensitive body can be mounted on a rotary member such as a drum, a belt and the like, or a sheet. Incidentally, in general, the drum or the belt is used. For example, in the drum-type photosensitive member, the photo-conductor is deposited or coated on an aluminium alloy cylinder and the like.

In the first embodiment, while an example that the charge means comprises a charger in which three walls formed from tungsten wires are covered by metallic shields such as aluminium was explained, a so-called contact charging method wherein a charge roller rotated by rotation of the photosensitive drum is contacted with the photosensitive drum and the photosensitive drum is charged by applying voltage to the charge roller may be used.

Incidentally, the charge means may be of a blade (charge blade) type, pad type, block type rod type or wire type, as well as a roller type.

Further, the cleaning means for removing the residual toner from the photosensitive drum may comprise a blade, a fur brush or a magnet brush.

The process cartridge incorporates therein an electrophotographic photosensitive member, a toner containing portion and at least one process means. Accordingly, other than the above-mentioned process cartridge, the process cartridge may incorporate therein an electrophotographic photosensitive member and a developing means as a unit which can removably be mounted to an image forming apparatus, or may incorporate therein an electrophotographic photosensitive member and a cleaning means as a unit which can removably be mounted to an image forming apparatus, or may incorporate therein an electrophotographic photosensitive member, a developing means or a cleaning means, and a charge means as a unit which can removably be mounted to an image forming apparatus.

Further, in the above-mentioned embodiment, while an example that the image forming apparatus is embodied as a laser beam printer was explained, the present invention is not limited to such an example, but may be, for example, an electrophotographic copying machine, a facsimile system, a word processor or the like.

As mentioned above, according to the present invention, since the seal member(s) are urged or pressed by the edge portion(s) of the blade support member(s), even when the seal member generating great repelling force when compressed is used, the influence of the repelling force of the seal member can be reduced.

What is claimed is:

1. A process cartridge, removably mountable to a main body of an electrophotographic image forming apparatus, including an electrophotographic photosensitive member and process means for acting on said electrophotographic photosensitive member, said process cartridge comprising:

a cartridge frame;

a blade member that acts on toner;

a support member for supporting said blade member; and a seal member provided for preventing the toner from leaking from a predetermined area, wherein said seal member is formed from a liquid-foam material to be solidified as an elastomer, and is spanned between an edge corner of said support member, along a longitudinal direction thereof, and said cartridge frame so as to prevent leakage of the toner from said cartridge frame.

2. A process cartridge according to claim 1, wherein said blade member is a cleaning blade member provided in said process cartridge for removing residual toner remaining on said electrophotographic photosensitive member, which is drum-shaped, wherein said support member is formed from a metal sheet, and wherein said seal member is abutted along and against said edge corner of said support member, said edge corner being opposite, in a short direction of said support member, to a supporting edge of said support member supporting said blade member.

3. A process cartridge according to claim 1, wherein said blade member is a developing blade member for regulating an amount of toner adhered to a developing roller provided in said process cartridge for developing a latent image formed on said electrophotographic photosensitive member, which is drum-shaped, wherein said support member is formed from a metal sheet, and wherein said seal member is abutted along and against said edge corner of said support member, said edge corner being opposite, in a short direction of said support member, to a supporting edge of said support member supporting said blade member.

4. A process cartridge according to claim 2 or 3, wherein said cartridge frame includes an upper frame and a lower frame detachably connected to said upper frame; said seal member is formed by pouring the liquid-foam material into a groove formed in said upper frame and said support member is attached to said lower frame; said seal member is abutted against said edge corner of said support member when said upper frame and said lower frame are interconnected; and said upper frame is positioned upwardly and said lower frame is positioned downwardly when said process cartridge is mounted to the main body of the electrophotographic image forming apparatus.

5. A process cartridge according to claim 2 or 3, wherein the liquid-foam material to be solidified as the elastomer is a formed polyurethane.

6. A process cartridge, removably mountable onto a main body of an electrophotographic image forming apparatus, including an electrophotographic photosensitive member; a charge member for charging said electrophotographic photosensitive member; and a developing roller for developing a latent image formed on said electrophotographic photosensitive member and for supplying toner to said electrophotographic photosensitive member by rotation of said developing roller, said process cartridge comprising:

a cartridge frame;

a cleaning blade member made of a rubber and contacted with said electrophotographic photosensitive member to remove residual toner remaining on said electrophotographic photosensitive member;

a support member made of a metal sheet and attached to said cartridge frame to support said cleaning blade member; and a seal member provided for preventing the toner removed from said electrophotographic photosensitive member by said cleaning blade member from leaking between said support member and said cartridge frame, wherein said seal member is formed from a foamed polyurethane as liquid-foam material to be solidified as an elastomer, and is spanned between an edge corner of said support member, opposite in a widthwise direction thereof to an edge of said support member supporting said cleaning blade member, and along said edge corner and said cartridge frame so as to prevent leakage of the toner from said cartridge frame.

7. A process cartridge according to claim 6, wherein said cartridge frame includes an upper frame and a lower frame detachably connected to said upper frame; said seal member is formed by pouring the liquid-foam material into a groove formed in said upper frame and said support member is attached to said lower frame; said seal member is abutted against said edge corner of said support member when said upper frame and said lower frame are interconnected; and said upper frame is positioned upwardly and said lower frame is positioned downwardly when said process cartridge is mounted to the main body of the electrophotographic image forming apparatus.

8. A process cartridge, removably mountable onto a main body of an electrophotographic image forming apparatus, including an electrophotographic photosensitive member; a charge member for charging said electrophotographic photosensitive member; and a developing roller for developing a latent image formed on said electrophotographic photosensitive member and for supplying toner to said electrophotographic photosensitive member by a rotation of said developing roller, said process cartridge comprising:

a cartridge frame;

a cleaning blade member made of a rubber contacted with said electrophotographic photosensitive member to remove residual toner remaining on said electrophotographic photosensitive member;

a developing blade member made of a rubber for regulating an amount of toner adhered to said developing roller;

a support member made of a metal sheet and attached to said cartridge frame to support said developing blade member; and a seal member provided for preventing the toner supplied from said developing roller from leaking between said support member and said cartridge frame, wherein said seal member is formed from a foamed polyurethane as liquid-foam material to be solidified as an elastomer, and is spanned between an edge corner of said support member, opposite in a short direction thereof to an edge of said support member supporting said developing blade member, and along said edge corner and said cartridge frame so as to prevent leakage of the toner from said cartridge frame.

9. A process cartridge according to claim 8, wherein said cartridge frame includes an upper frame and a lower frame detachably connected to said upper frame; said seal member is formed by pouring the liquid-foam material into a groove formed in said upper frame and said support member is attached to said lower frame; said seal member is abutted against said edge corner of said support member when said upper frame and said lower frame are interconnected; and said upper frame is positioned upwardly and said lower frame is positioned downwardly when said process cartridge is mounted to the main body of the electrophotographic image forming apparatus.

10. A process cartridge, removably mountable onto a main body of an electrophotographic image forming apparatus, including an electrophotographic photosensitive member; a charge member for charging said electrophotographic photosensitive member; and a developing roller for developing a latent image formed on said electrophotographic photosensitive member and for supplying toner to said electrophotographic photosensitive member by a rotation of said developing roller, said process cartridge comprising:

a cartridge frame;

a developing blade member made of a rubber for regulating an amount of toner adhered to said developing roller;

a developing blade support member made of a sheet metal and attached to said cartridge frame to support said developing blade member; and a development seal member provided for preventing the toner supplied from said developing roller from leaking between said developing blade support member and said cartridge frame;

a cleaning blade member made of a rubber and contacted with said electrophotographic photosensitive member to remove a residual toner remaining on said electrophotographic photosensitive member;

a cleaning blade support member made of a sheet metal and attached to said cartridge frame to support said cleaning blade member; and a cleaning seal member provided for preventing the toner removed from said electrophotographic photosensitive member by said cleaning blade member from leaking between said cleaning blade support member and said cartridge frame, wherein said development seal member and said cleaning seal member are formed from a foamed polyurethane as liquid-foam material to be solidified as an elastomer, and said development seal member is spanned between an edge portion of said developing blade support member, opposite in a short direction thereof to an edge of said developing blade support member supporting said developing blade member, and along said edge portion of said developing blade support member and said cartridge frame so as to be contacted with said edge portion of said developing blade support member and said cartridge frame, while said cleaning seal member is spanned between an edge corner of said cleaning blade support member, opposite in a short direction thereof to an edge of said cleaning blade support member supporting said cleaning blade member, and along said edge corner of said cleaning blade support member and said cartridge frame so as to prevent leakage of the toner from said cartridge frame.

11. A process cartridge according to claim 10, wherein said cartridge frame includes an upper frame and a lower frame detachably connected to said upper frame; said development seal member and said cleaning seal member are formed by pouring the liquid-foam material into grooves formed in said upper frame and said developing blade support member and said cleaning blade support member are attached to said lower frame; said development seal member is abutted against said edge corner of said developing blade support member and said cleaning seal member is abutted against said edge portion of said cleaning blade support member when said upper frame and said lower frame are interconnected; and said upper frame is positioned upwardly and said lower frame is positioned downwardly when said process cartridge is mounted to the main body of the electrophotographic image forming apparatus.

12. An electrophotographic image forming apparatus to which a process cartridge is removably mountable and which is adapted to form an image on a recording medium, said image forming apparatus comprising:

(a) a mounting member capable of removably mounting a process cartridge including an electrophotographic photosensitive member and process means for acting on said electrophotographic photosensitive member, and having a cartridge frame, a blade member that acts on toner, a support member for supporting said blade member, and a seal member provided for preventing the toner from leaking from a predetermined area, said seal member being formed from a liquid-foam material to be solidified as an elastomer, and said seal member being spanned between an edge corner of said support member, along a longitudinal direction thereof, and said cartridge frame so as to prevent leakage of the toner from said cartridge frame;

(b) a convey member for conveying the recording medium;

(c) a transfer member for transferring, to the recording medium, a toner image formed on said electrophotographic photosensitive member of said process cartridge mounted to said mounting member; and (d) a fixing roller for fixing, to the recording medium, the toner image transferred to the recording medium.

13. An electrophotographic image forming apparatus to which a process cartridge is removably mountable and which is adapted to form an image on a recording medium, said image forming apparatus comprising:

(a) a mounting member capable of removably mounting a process cartridge including a cartridge frame, an electrophotographic photosensitive member, a charge member for charging said electrophotographic photosensitive member, a developing roller for developing a latent image formed on said electrophotographic photosensitive member and for supplying toner to said electrophotographic photosensitive member by rotation of said developing roller, a cleaning blade member made of a rubber and contacted with said electrophotographic photosensitive member to remove residual toner remaining on said electrophotographic photosensitive member, a support member made of a metal sheet and attached to said cartridge frame to support said cleaning blade member, and a seal member provided for preventing the toner removed from said electrophotographic photosensitive member by said cleaning blade member from leaking between said support member and said cartridge frame, said seal member being formed from a foamed polyurethane as liquid-foam material to be solidified as an elastomer, and said seal member being spanned between an edge corner of said support member, opposite in a short direction thereof to an edge of said support member supporting said cleaning blade member, and along said edge corner and said cartridge frame so as to prevent leakage of the toner from said cartridge frame;

(b) a convey member for conveying the recording medium;

(c) a transfer member for transferring, to the recording medium, a toner image formed on said electrophotographic photosensitive member of said process cartridge mounted to said mounting member; and (d) a fixing roller for fixing, to the recording medium, the toner image transferred to the recording medium.

14. An electrophotographic image forming apparatus to which a process cartridge is removably mountable and which is adapted to form an image on a recording medium, said image forming apparatus comprising:

(a) a mounting member capable of removably mounting a process cartridge including a cartridge frame, an electrophotographic photosensitive member, a charge member for charging said electrophotographic photosensitive member, a cleaning blade member made of a rubber and contacted with said electrophotographic photosensitive member to remove residual toner remaining on said electrophotographic photosensitive member, a developing roller for developing a latent image formed on said electrophotographic photosensitive member and for supplying toner to said electrophotographic photosensitive member by a rotation of said developing roller, a developing blade member made of a rubber for regulating an amount of toner adhered to said developing roller, a support member made of a metal sheet and attached to said cartridge frame to support said developing blade member, and a seal member provided for preventing the toner supplied from said developing roller from leaking between said support member and said cartridge frame, said seal member being formed from a foamed polyurethane as liquid-foam material to be solidified as an elastomer, and said seal member being spanned between an edge corner of said support member, opposite in a short direction thereof to an edge of said support member supporting said developing blade member, and along said edge corner and said cartridge frame so as to prevent leakage of the toner from said cartridge frame;

(b) a convey member for conveying the recording medium;

(c) a transfer member for transferring, to the recording medium, a toner image formed on said electrophotographic photosensitive member of said process cartridge mounted to said mounting member; and (d) a fixing roller for fixing, to the recording medium, the toner image transferred to the recording medium.

15. An electrophotographic image forming apparatus to which a process cartridge is removably mountable and which is adapted to form an image on a recording medium, said image forming apparatus comprising:

(a) a mounting member capable of removably mounting a process cartridge including a cartridge frame, an electrophotographic photosensitive member, a charge member for charging said electrophotographic photosensitive member, a developing roller f or developing a latent image formed on said electrophotographic photosensitive member and for supplying toner to said electrophotographic photosensitive member by a rotation of said developing roller, a developing blade member made of a rubber for regulating an amount of toner adhered to said developing roller, a developing blade support member made of a metal sheet and attached to a cartridge frame to support said developing blade member, a development seal member provided for preventing the toner supplied from said developing roller from leaking between said developing blade support member and said cartridge frame, a cleaning blade member made of a rubber and contacted with said electrophotographic photosensitive member to remove a residual toner remaining on said electrophotographic photosensitive member, a cleaning blade support member made of a metal sheet and attached to said cartridge frame to support said cleaning blade member, and a cleaning seal member provided for preventing the toner removed from said electrophotographic photosensitive member by said cleaning blade member from leaking between said cleaning blade support member and said cartridge frame, said development seal member and said cleaning seal member being formed from a foamed polyurethane as liquid-foam material to be solidified as an elastomer, and said development seal member being spanned between an edge corner of said developing blade support member, opposite in a short direction thereof to an edge of said developing blade support member supporting said developing blade member, and along said edge corner of said developing blade support member and said cartridge frame so as to prevent leakage of the toner from said cartridge frame, while said cleaning seal member is spanned between an edge portion of said cleaning blade support member, opposite in a short direction thereof to an edge of said cleaning blade support member supporting said cleaning blade member, and along said edge portion of said cleaning blade support member and said cartridge frame so as to be contacted with said edge portion of said cleaning blade support member and said cartridge frame;

(b) a convey member for conveying the recording medium;

(c) a transfer member for transferring, to the recording medium, a toner image formed on said electrophotographic photosensitive member of said process cartridge mounted to said mounting member; and (d) a fixing roller for fixing, to the recording medium, the toner image transferred to the recording medium.

* * * * *

UNITED STATES PATENT AND TRADEMARK OFFICE

CERTIFICATE OF CORRECTION

PATENT NO. : 5,809,374

DATED : September 15, 1998

INVENTOR(S) : TADAYUKI TSUDA ET AL.

It is certified that error appears in the above-identified patent and that said Letters Patent is hereby corrected as shown below:

COLUMN 1

Line 14, "be" (second occurrence) should be deleted.

COLUMN 2

Line 63, "members;" should read --member;--.

COLUMN 4

Line 30, "frictional" should read --a fictional--.

COLUMN 5

Line 61, "it is" should read --it--.

COLUMN 6

Line 23, "in-this" should read --in this--.

COLUMN 7

Line 37, "as is in" should read --as in--.

UNITED STATES PATENT AND TRADEMARK OFFICE

CERTIFICATE OF CORRECTION

PATENT NO. : 5,809,374

DATED : September 15, 1998

INVENTOR(S) : TADAYUKI TSUDA ET AL.

It is certified that error appears in the above-identified patent and that said Letters Patent is hereby corrected as shown below:

COLUMN 11

Line 18, "as is in" should read --as in--.
Line 66, "block type" should read --block type,--.

COLUMN 17

Line 15, "f or" should read --for--.

Signed and Sealed this

Twenty-seventh Day of July, 1999

*Attest:*

Q. TODD DICKINSON

*Attesting Officer*

*Acting Commissioner of Patents and Trademarks*